US008210860B2

(12) United States Patent
Fukuda

(10) Patent No.: US 8,210,860 B2
(45) Date of Patent: Jul. 3, 2012

(54) CONNECTOR AND DEVICE INCLUDING THE SAME

(75) Inventor: Takashi Fukuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 266 days.

(21) Appl. No.: 12/723,292

(22) Filed: Mar. 12, 2010

(65) Prior Publication Data

US 2010/0240231 A1 Sep. 23, 2010

(30) Foreign Application Priority Data

Mar. 19, 2009 (JP) ..... 2009-68985

(51) Int. Cl.
*H01R 13/44* (2006.01)

(52) U.S. Cl. ..... 439/140; 439/38

(58) Field of Classification Search ..... 439/140, 439/141, 38
See application file for complete search history.

(56) References Cited

U.S. PATENT DOCUMENTS

| | | | | |
|---|---|---|---|---|
| 3,995,209 | A * | 11/1976 | Weston | 323/355 |
| 5,466,164 | A | 11/1995 | Miyazaki et al. | |
| 2004/0266264 | A1 * | 12/2004 | Ohta et al. | 439/607 |
| 2007/0134947 | A1 | 6/2007 | Neidlein | |
| 2011/0143555 | A1 * | 6/2011 | Pan | 439/38 |

FOREIGN PATENT DOCUMENTS

| | | |
|---|---|---|
| JP | 04-317899 | 11/1992 |
| JP | 06-267607 | 9/1994 |
| JP | 07-014578 | 3/1995 |
| JP | 07-280862 | 10/1995 |
| JP | 11-026116 | 1/1999 |
| JP | 2007-073373 | 3/2007 |
| JP | 2007-511053 | 4/2007 |
| JP | 2008-071246 | 3/2008 |

OTHER PUBLICATIONS

Japanese Office Action dated Feb. 22, 2011 issued in corresponding Japanese Patent Application No. 2009-068985.

* cited by examiner

*Primary Examiner* — Tulsidas C Patel
*Assistant Examiner* — Travis Chambers
(74) *Attorney, Agent, or Firm* — Staas & Halsey LLP

(57) ABSTRACT

A connector includes, a frame section which has an inner space defined by side walls and a bottom portion, a plurality of pins protruding from the bottom portion in the inner space, a cover which has a magnet and a plurality of holes, where the cover is movable along the pins in the inner space between a first position and a second position that the pins are electrically connected, a detection unit that output a detection signal, an electromagnet provided at a position on the bottom portion opposing the magnet, and a control unit that controls a moving of the cover between the first position and the second position by bringing the electromagnet in a normal ON state or in an OFF state or a reverse ON state.

14 Claims, 15 Drawing Sheets

CONNECTOR AND DEVICE INCLUDING THE SAME

CROSS-REFERENCE TO RELATED APPLICATIONS

This application is based upon and claims the benefit of priority of the prior Japanese Patent Application No. 2009-68985, filed on Mar. 19, 2009, the entire contents of which are incorporated herein by reference.

FIELD

The embodiments discussed herein relate to a connector and a device including the connector.

BACKGROUND

FIG. 1 illustrates an example of a connector of a related art. A male connector 1 has a plurality of pins 2, and is provided on a substrate 5. A pair of guide pins 6 are also provided on the substrate 5. On the other hand, a female connector 7 is provided on a substrate different from the substrate 5 or a device 8. The device 8 has guide holes (not shown) in which the guide pins 6 are to be inserted. The guide pins 6 position the connectors 1 and 7 relative to each other during connection of the connectors 1 and 7, and make the connection smooth and accurate. Since the connectors 1 and 7 are connected by being guided by the guide pins 6, the pins 2 are insusceptible to damage such as bending.

To properly position and guide the connectors 1 and 7, the guide pins 6 need to extend perpendicularly to a surface of the substrate 5 and to be accurately located at designed positions. However, the guide pins 6 are sometimes not exactly perpendicular to the surface of the substrate 5 because of manufacturing errors and attachment errors of components. In this case, the connectors 1 and 7 are not smoothly and accurately guided during connection, and the pins 2 may suffer damage such as bending. Moreover, if the pins 2 suffer damage such as bending, it is highly likely that the connectors 1 and 7 cannot be connected electrically.

When the guide pins 6 are provided on the substrate 5, they reduce the available area on the substrate 5, and this reduces the flexibility in laying out wires, elements, etc. Similarly, the flexibility in laying out wires, elements, etc. on the device 8 is reduced by the guide holes provided in the device 8.

SUMMARY

According to an aspect of the invention, a connector includes, a frame section which has an inner space defined by side walls and a bottom portion, a plurality of pins protruding from the bottom portion within the inner space, a cover which has a magnet and a plurality of holes, where the cover is movable along the pins in the inner space between a first position and a second position that the pins are electrically connected, a detection unit that output a detection signal, an electromagnet provided at a position on the bottom portion opposing the magnet, and a control unit that controls a movement of the cover between the first position and the second position by bringing the electromagnet in a normal ON state or in an OFF state or a reverse ON state.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed. Additional aspects and/or advantages will be set forth in part in the description which follows and, in part, will be apparent from the description, or may be learned by practice of the invention.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
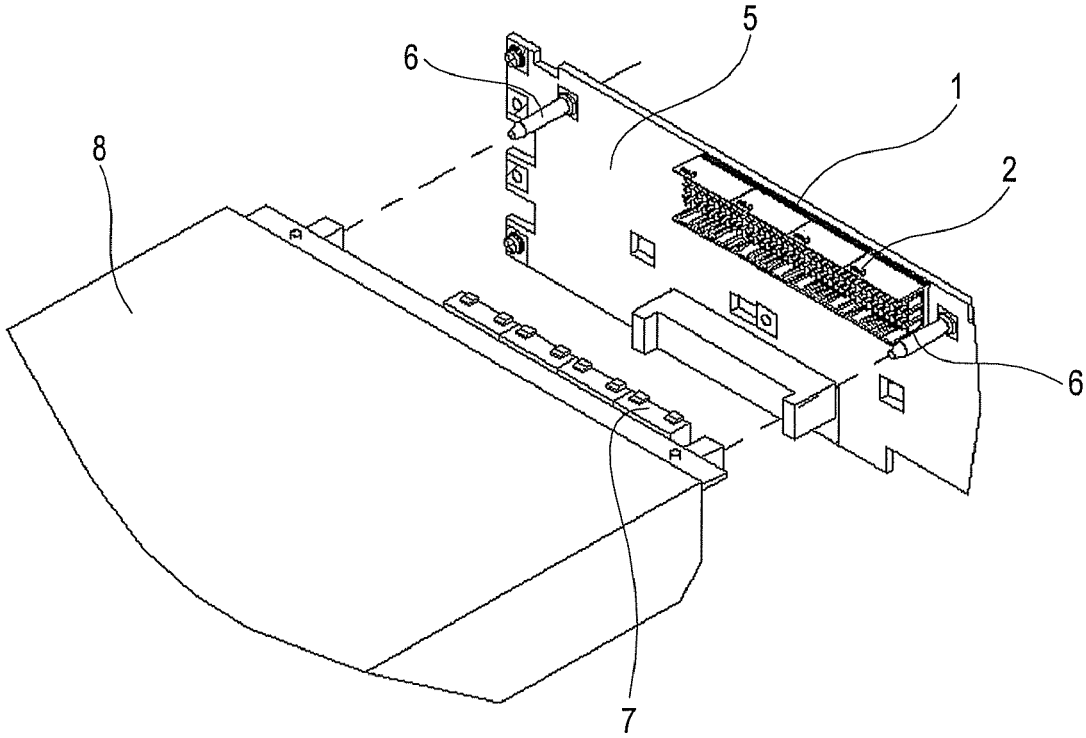
FIG. 1 illustrates an example of a connector of the related art.

Reference will now be made in detail to the embodiments, examples of which are illustrated in the accompanying drawings, wherein like reference numerals refer to the like elements throughout. The embodiments are described below to explain the present invention by referring to the figures.

In an embodiment, a connector and a device including the connector are disclosed. A cover including a magnet and a plurality of holes, through which a plurality of pins are to pass, is provided movably between first and second positions in an inner space of a frame section. The pins are protected by the cover at the first position, and are exposed at the second position so as to be electrically connectable to an external member. The frame section is provided with a detection unit for outputting a detection signal when detecting insertion of the external member in the inner space. During a period when a detection signal is not input, a control unit moves the cover to the first position by bringing an electromagnet opposing the magnet of the cover into a normal ON state for generating a magnetic field having the same polarity as that of an opposing surface of the magnet. When a detection signal is input, the control unit moves the cover to the second position by bringing the electromagnet into an OFF state, or a reverse ON state for generating a magnetic field having a polarity opposite the polarity of the opposing surface of the magnet.

By controlling the electromagnet to be in the normal ON state, the cover can prevent damage to the pins at the first position. Further, by controlling the electromagnet to be in the OFF state or the reverse ON state, the cover moves to the second position so as to allow a reliable electrical connection between the external member and the pins.

Figure 2:
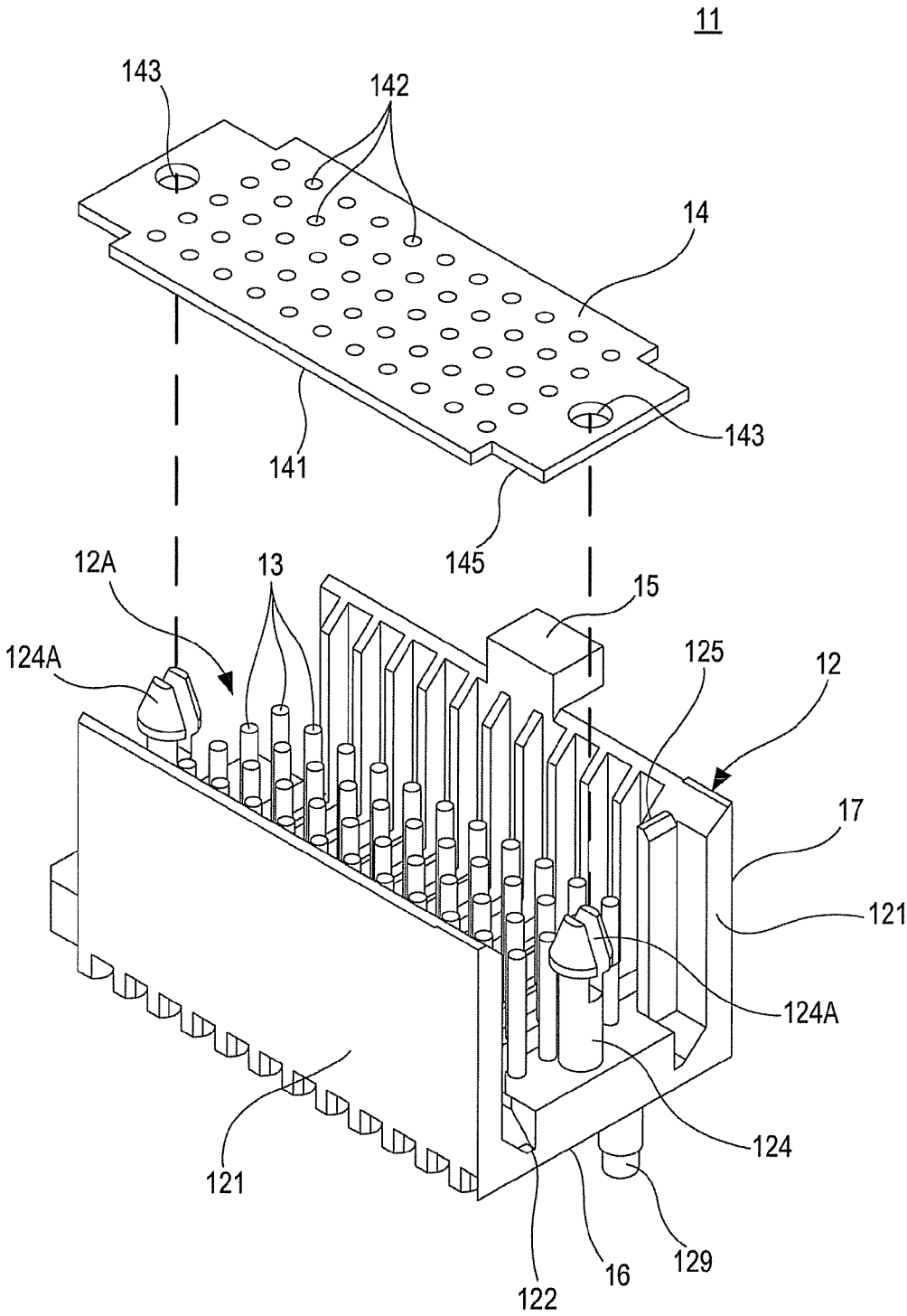
FIG. 2 illustrates a connector according to an embodiment of the present invention, from which a cover is shown as removed.

Referring to FIG. 2 and subsequent figures, a description will be given below of connectors and devices including the connectors according to embodiments of the present invention.

FIG. 2 illustrates a connector according to an embodiment of the present invention, from which a cover is shown as removed. Referring to FIG. 2, a connector 11 includes a frame section 12, a plurality of pins 13, a cover 14, a detection unit 15, electromagnets 16, and a control unit 17.

The frame section 12 has an inner space 12A defined by a pair of opposing side walls 121 and a bottom portion 122 connecting the side walls 121. The side walls 121 have guide portions 125, and the bottom portion 122 has a pair of guide pins 124 extending in the same direction as that of the pins 13. Stoppers 124A are provided at leading ends of the guide pins 124. Attachment portions 129 provided on a side face of the bottom portion 122 allow easy attachment of the connector 11 to a substrate or a device (not shown). The attachment portions 129 may be omitted.

The cover 14 may be formed by a plate-shaped member made of an insulating material. The cover 14 includes a magnet 141, a plurality of holes 142 through which the pins 13 are to pass, guide holes 143 for the guide pins 124, and cutouts 145 to be guided by the guide portions 125 of the side walls 121. The cover 14 is movable along the pins 13 in the inner space 12A between a first position and a second position. The cover 14 protects the pins 13 at the first position, and exposes the pins 13 at the second position so that the pins 13 are electrically connectable to an external member (not shown) such as another connector.

Figure 3:
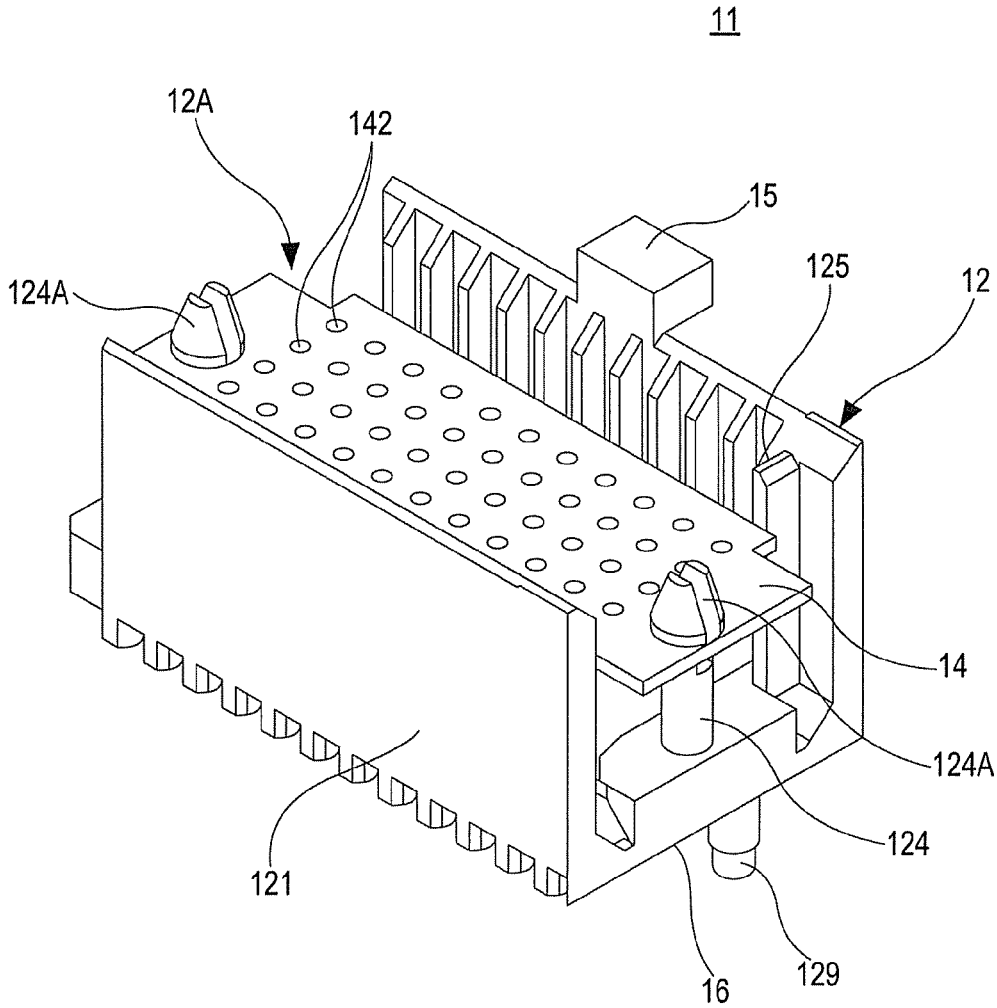
FIG. 3 illustrates a state in which the cover of the connector in FIG. 2 is at a first position.
Figure 4:
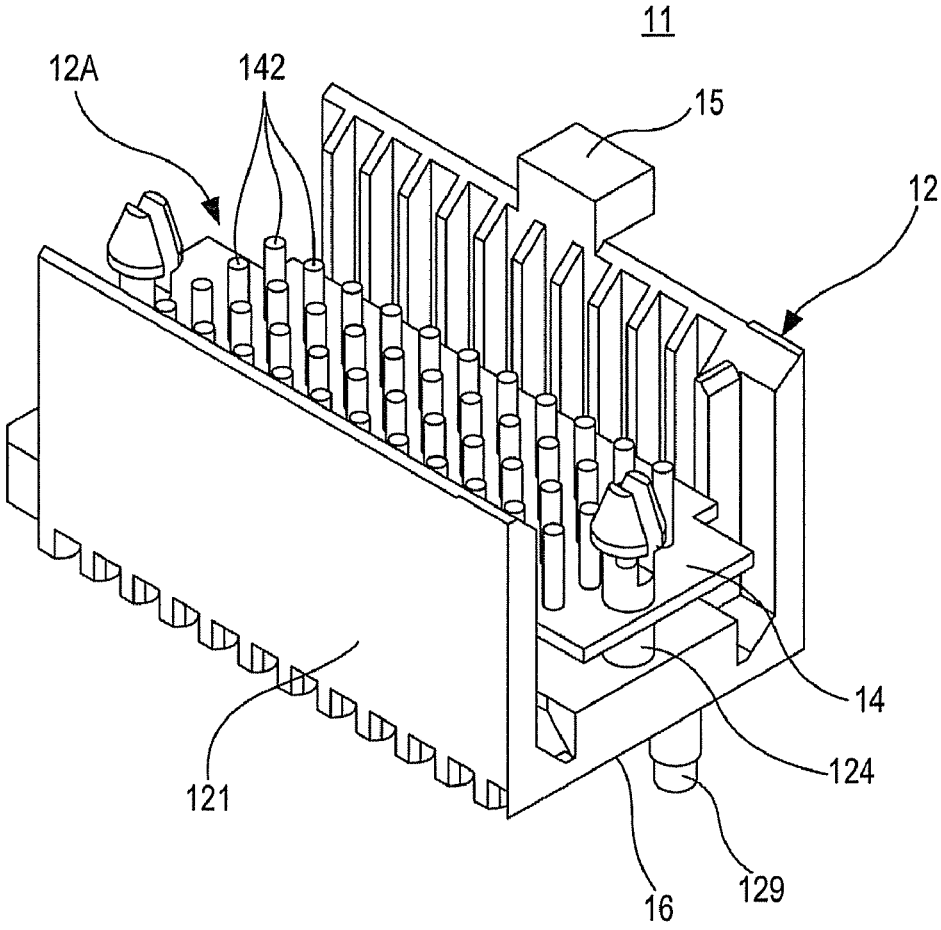
FIG. 4 illustrates a state in which the cover of the connector in FIG. 2 is at a second position.

FIG. 3 illustrates a state in which the cover 14 of the connector 11 in FIG. 2 is at the first position, and FIG. 4 illustrates a state in which the cover 14 of the connector 11 is at the second position.

The guide portions 125 provided on the side walls 121 are engaged with the cover 14, and thereby guide a movement of the cover 14 between the first and second positions. The pins 13 themselves also guides movement of the cover 14 between the first and second positions. For this reason, the cover 14 can smoothly and stably move between the first and second positions. Upward movement of the cover 14 beyond the first position, that is, a movement in a direction opposite the second position is restricted by the stoppers 124A of the guide pins 124.

The pins 13 may be formed of an electrically conductive material, and protrude upward in a columnar shape from the bottom portion 122 in the inner space 12A. The protrusion amount of the pins 13 from the bottom portion 122 is such that the leading ends of the pins 13 do not protrude from upper edges of the side walls 121. When the cover 14 is at the first position, the leading ends of the pins 13 do not protrude from the holes 142 of the cover 14. While the cross sections of the pins 13 taken along a plane parallel to a surface of the bottom portion 122 are circular as an example, the shape of the cross sections is not limited particularly. The cross sections of the pins 13 may be shaped like an ellipse, a rectangle, or a polygon having five or more angles. In an embodiment, the leading ends of the pins 13 are tapered or rounded.

The detection unit 15 is provided at an appropriate position in the frame section 12, and outputs a detection signal when detecting insertion of the external member in the inner space 12A. The detection unit 15 can be formed by, for example, an optical sensor, a contact sensor, or an ultrasonic sensor, and the type of the sensor is not limited particularly. In this embodiment, the detection unit 15 is provided at an upper edge of one of the side walls 121 as an example. The electromagnets 16 are provided at positions on the bottom portion 122 facing the magnet 141.

The electromagnets 16 are controlled by the control unit 17 according to a detection signal output from the detection unit 15. During a period when a detection signal is not input from the detection unit 15, the control unit 17 moves the cover 14 to the first position by bringing the electromagnets into the normal ON state for generating a magnetic field having the same polarity as that of a surface of the magnet 141 opposing to the electromagnets. In contrast, when a detection signal is input, the control unit 17 moves the cover 14 to the second position by bringing the electromagnets 16 into the OFF state, or the reverse ON state for generating a magnetic field having a polarity opposite the polarity of the opposing surface of the magnet 141. For example, when it is assumed that the north pole of the magnet 141 points downward in FIG. 2, the north pole of the electromagnets 16 controlled in the normal ON state points upward, and the south pole of the electromagnets 16 controlled in the reverse ON state points upward.

Figure 5:
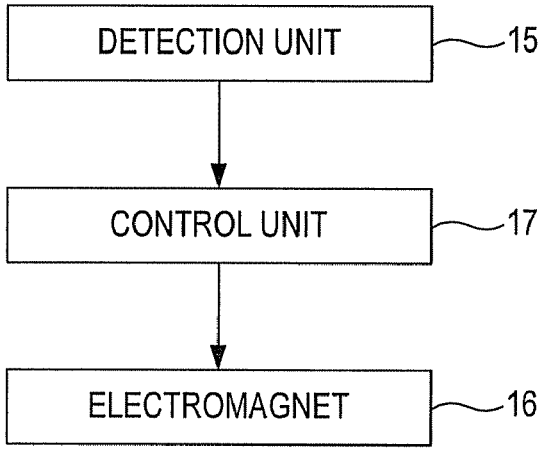
FIG. 5 illustrates a detection unit, a control unit, and electromagnets.

The control unit 17 may be provided at an arbitrary position in the connector 11, and is electrically connected to the detection unit 15 and the electromagnets 16, as shown in FIG. 5. Since FIG. 2 illustrates a state in which the control unit 17 is provided on the side wall 121 having the detection unit 15 for convenience of explanation, the control unit 17 is not shown in FIG. 2. Alternatively, the control unit 17 may be externally attached to the connector 11 as will be described below.

Figure 6:
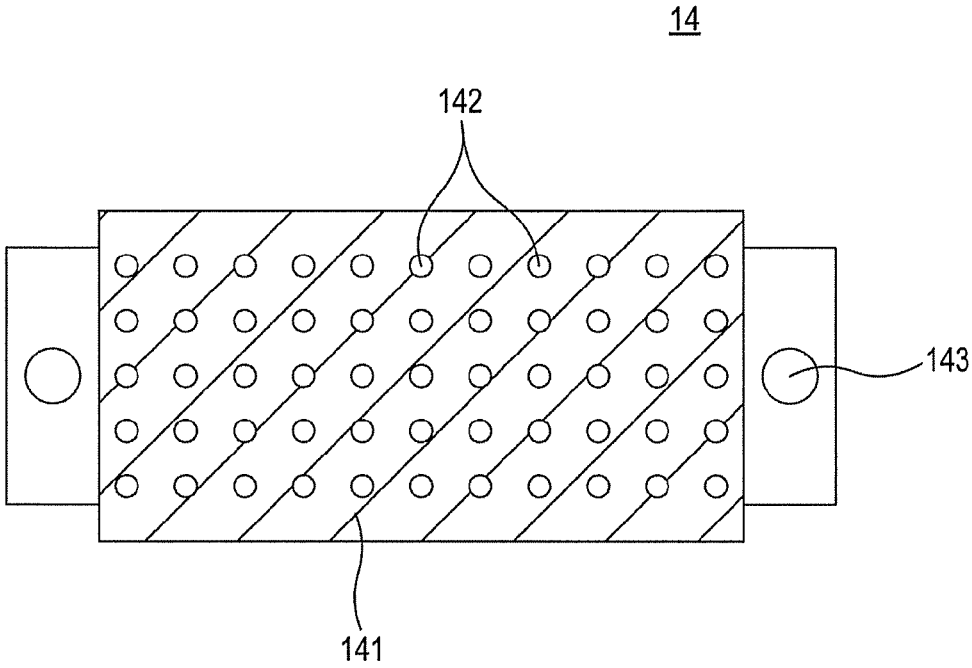
FIG. 6 illustrates an example of a cover.

FIG. 6 illustrates an example of a cover 14. In this example, a magnet 141 is provided in a portion of a bottom surface of the cover 14 except in areas where both end portions where guide holes 143 are provided.

Figure 7:
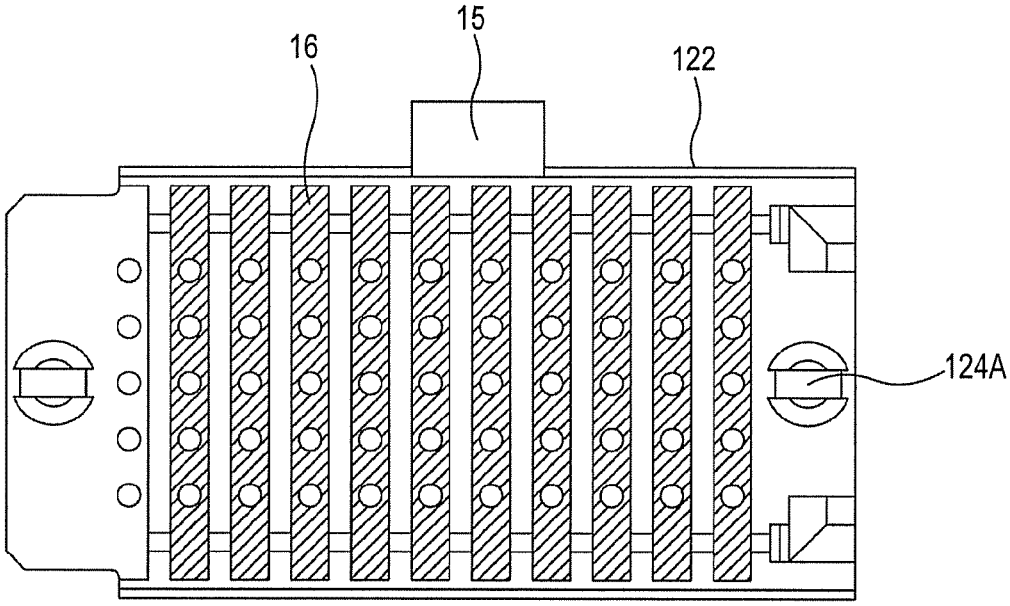
FIG. 7 illustrates a layout of electromagnets corresponding to the cover in FIG. 6.

FIG. 7 illustrates the layout of electromagnets 16 corresponding to the cover 14 in FIG. 6. In this case, the electromagnets 16 are provided in a portion of the surface of the bottom portion 122 of the frame section 12 except in areas where both end portions where guide pins 124 are provided.

Figure 8:
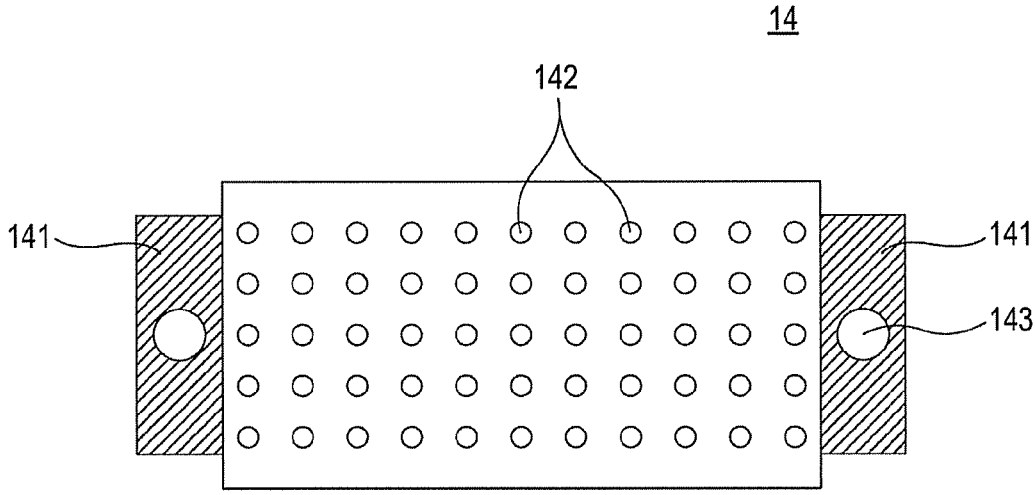
FIG. 8 illustrates another example of a cover.

FIG. 8 illustrates another example of a cover 14. In this example, magnets 141 are provided in portions of a bottom surface of the cover 14 except over a portion where holes 142 are provided, that is, in both end portions where guide holes 143 are provided. In other words, the cover 14 has first opposing sides that move along a pair of opposing side walls 121 and second opposing sides connecting ends of the first opposing sides. The magnets 141 are provided along the second opposing sides.

Figure 9:
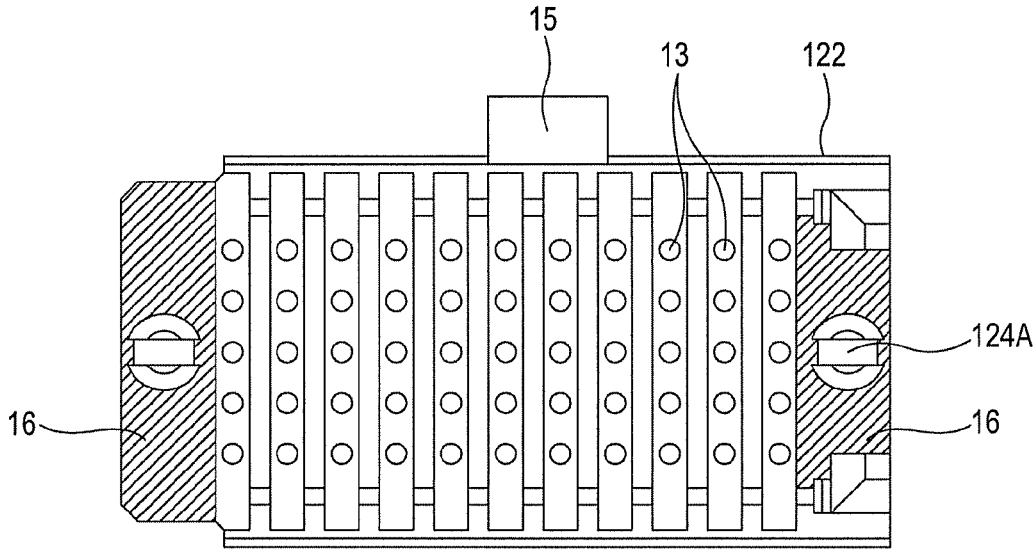
FIG. 9 illustrates a layout of electromagnets corresponding to the cover in FIG. 8.

FIG. 9 is a plan view illustrating the layout of electromagnets 16 corresponding to the cover 14 in FIG. 8. In this case, the electromagnets 16 are provided in portions of the surface of the bottom portion 122 of the frame section 12 except over portions where the pins 13 are provided, that is, in both end portions where guide pins 124 are provided.

According to the layout of the magnets 141 and the electromagnets 16 illustrated in FIGS. 8 and 9, the influence of the magnetic field of the magnets 141 and/or the electromagnets 16 on signals flowing through the pins 13 can be made smaller than in the layout illustrated in FIGS. 6 and 7.

It is only necessary that the magnets 141 on the cover 14 and the electromagnets 16 are arranged at positions facing each other. The layout of the magnets 141 and the electromagnets 16 is not particularly limited as long as it can stably keep the cover 14 at the first position under restriction of the stoppers 124A when the electromagnets 16 are set in the normal ON state.

Figure 10:
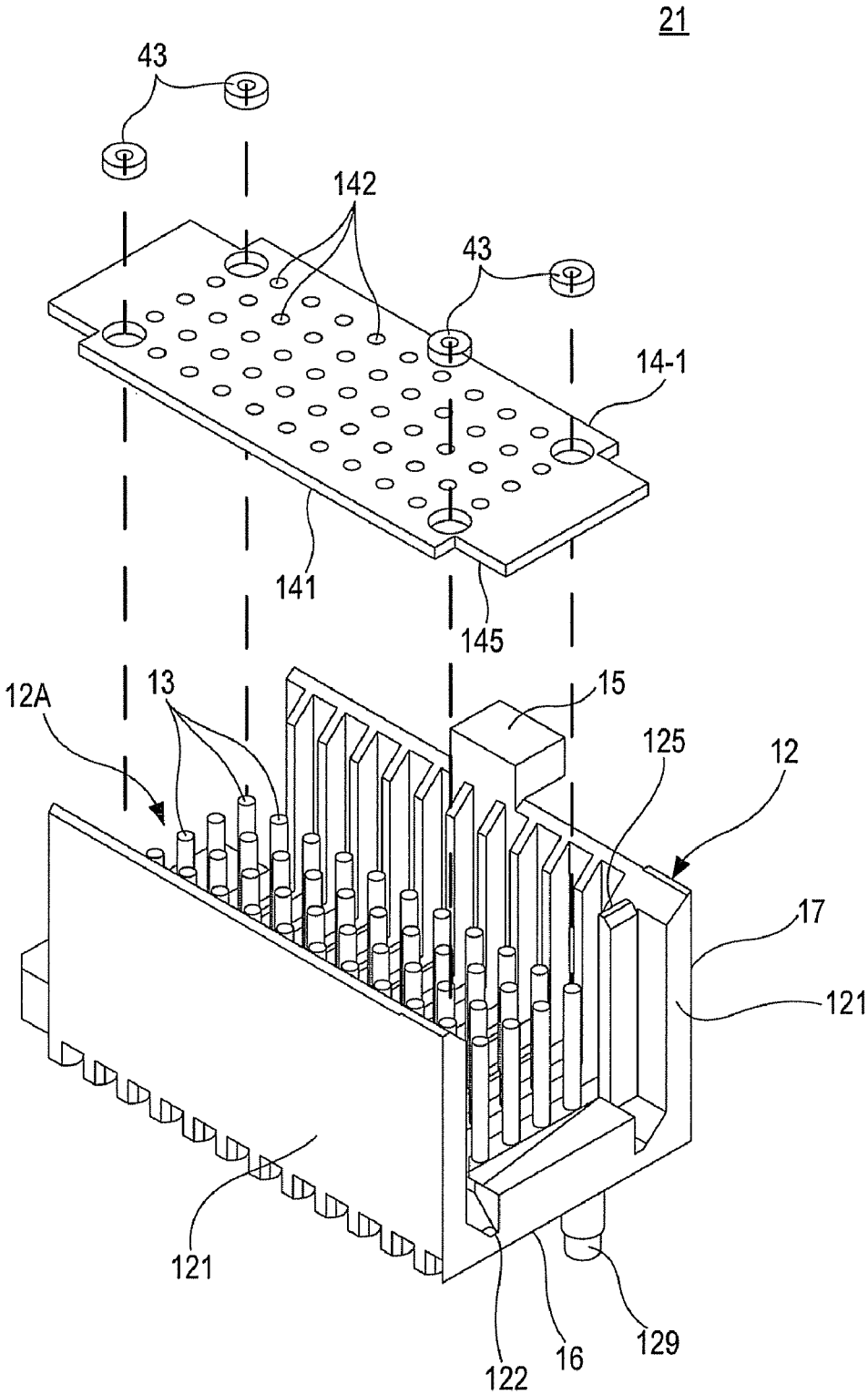
FIG. 10 illustrates a connector according to an embodiment of the present invention, from which a cover is shown as removed.
Figure 11:
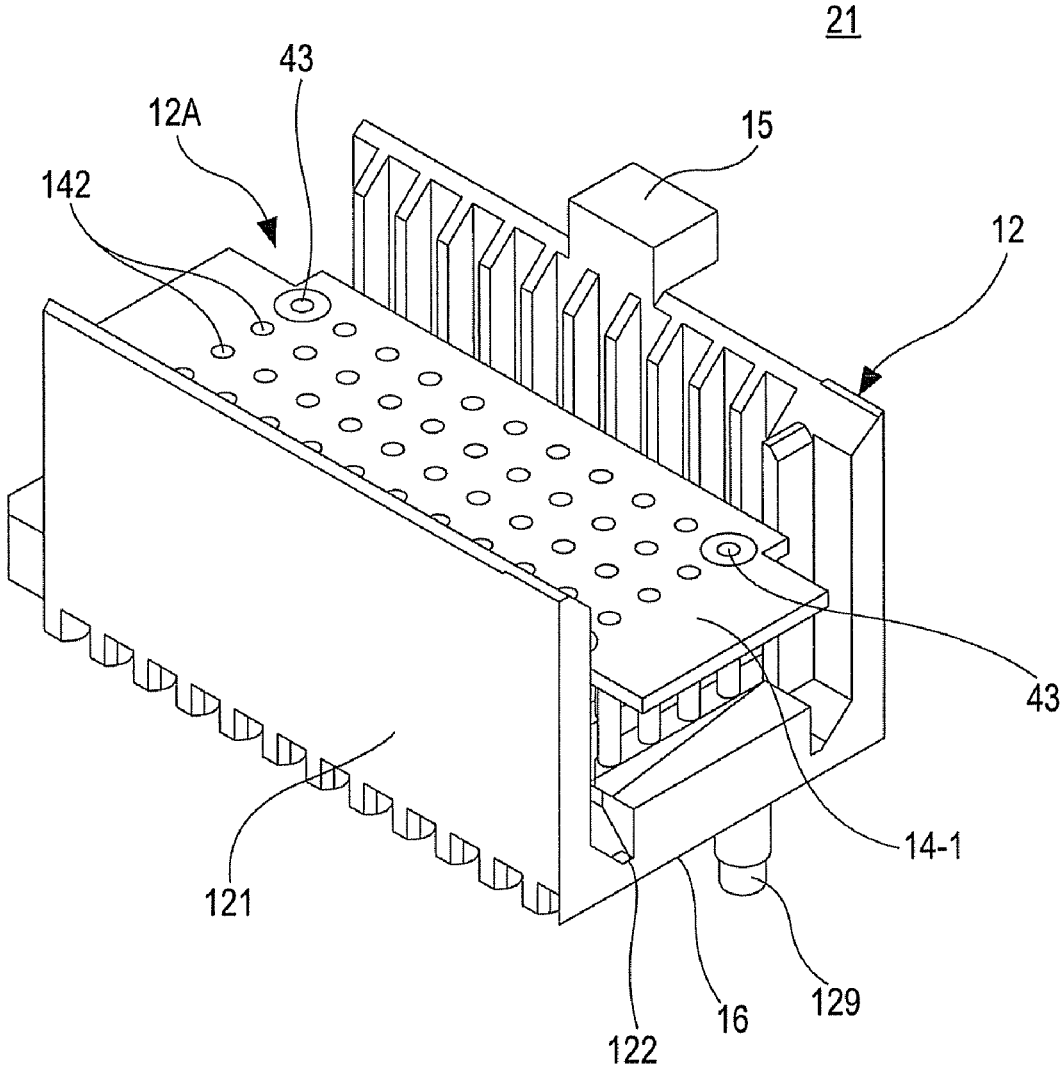
FIG. 11 illustrates a state in which the cover of the connector in FIG. 10 is at a first position.

FIG. 10 illustrates a connector according to an embodiment of the present invention, from which a cover is shown as removed. FIG. 11 illustrates a state in which the cover of the connector illustrated in FIG. 10 is at a first position. In FIGS. 10 and 11, the same components as those in FIG. 2 are denoted by the same reference numerals, and descriptions thereof are omitted.

In a connector 21 of an embodiment, guide pins 124 are not provided on a bottom portion 122 of a frame section 12. For this reason, a cover 14-1 does not have guide holes 143 for the guide pins 124. Hence, when a size of the connector 21 is equal to that of the connector 11 of the above-described embodiment, a larger number of pins 13 can be provided in the connector 21.

Holes 142A at four corners of the cover 14-1 are slightly larger than the other holes 142. Stoppers 43 fixed to leading ends of pins 13 at four corners are fitted in the holes 142A when the cover 14-1 is at the first position.

Figure 12:
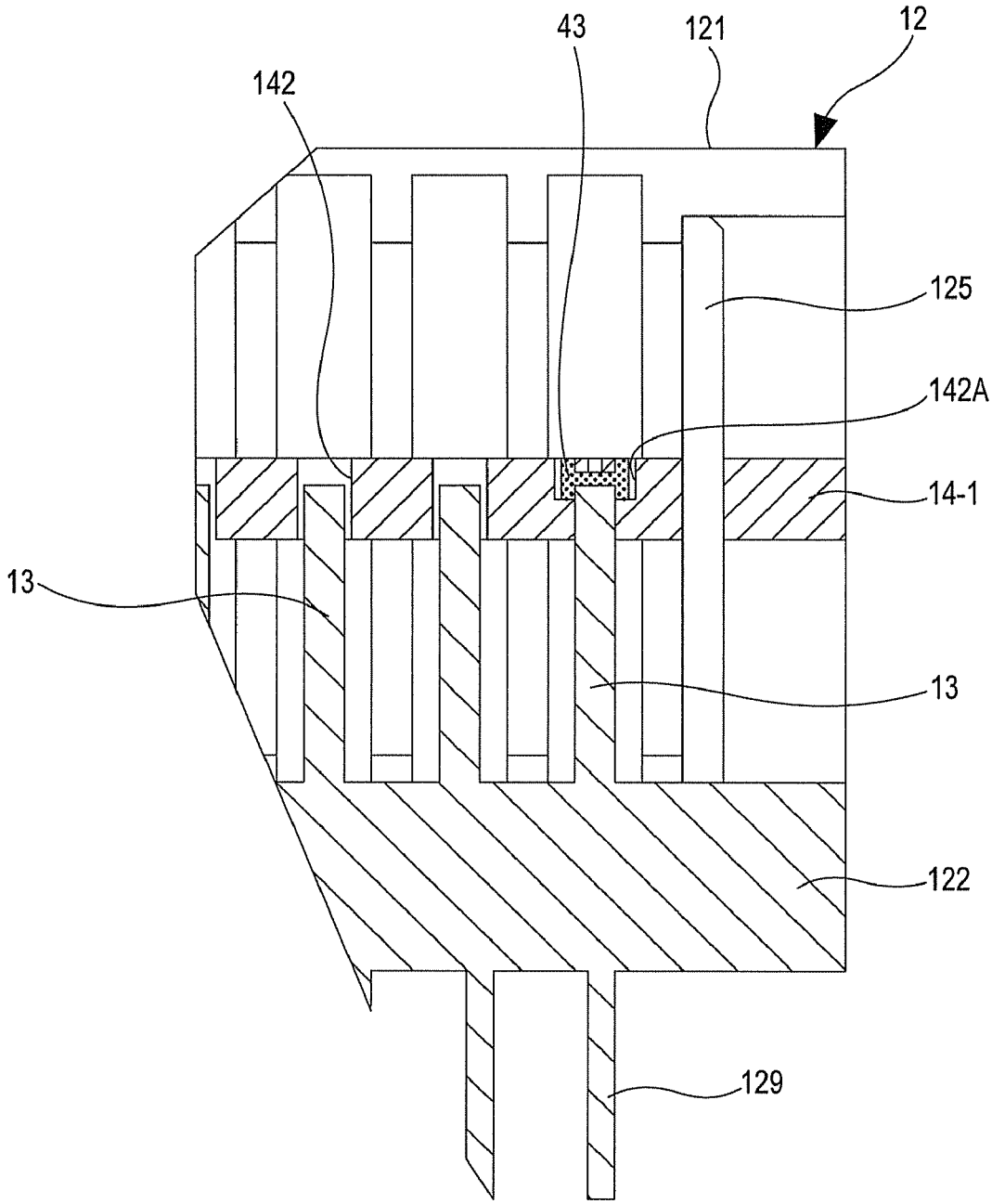
FIG. 12 illustrates a stopper and its surroundings in FIG. 11.
Figure 13:
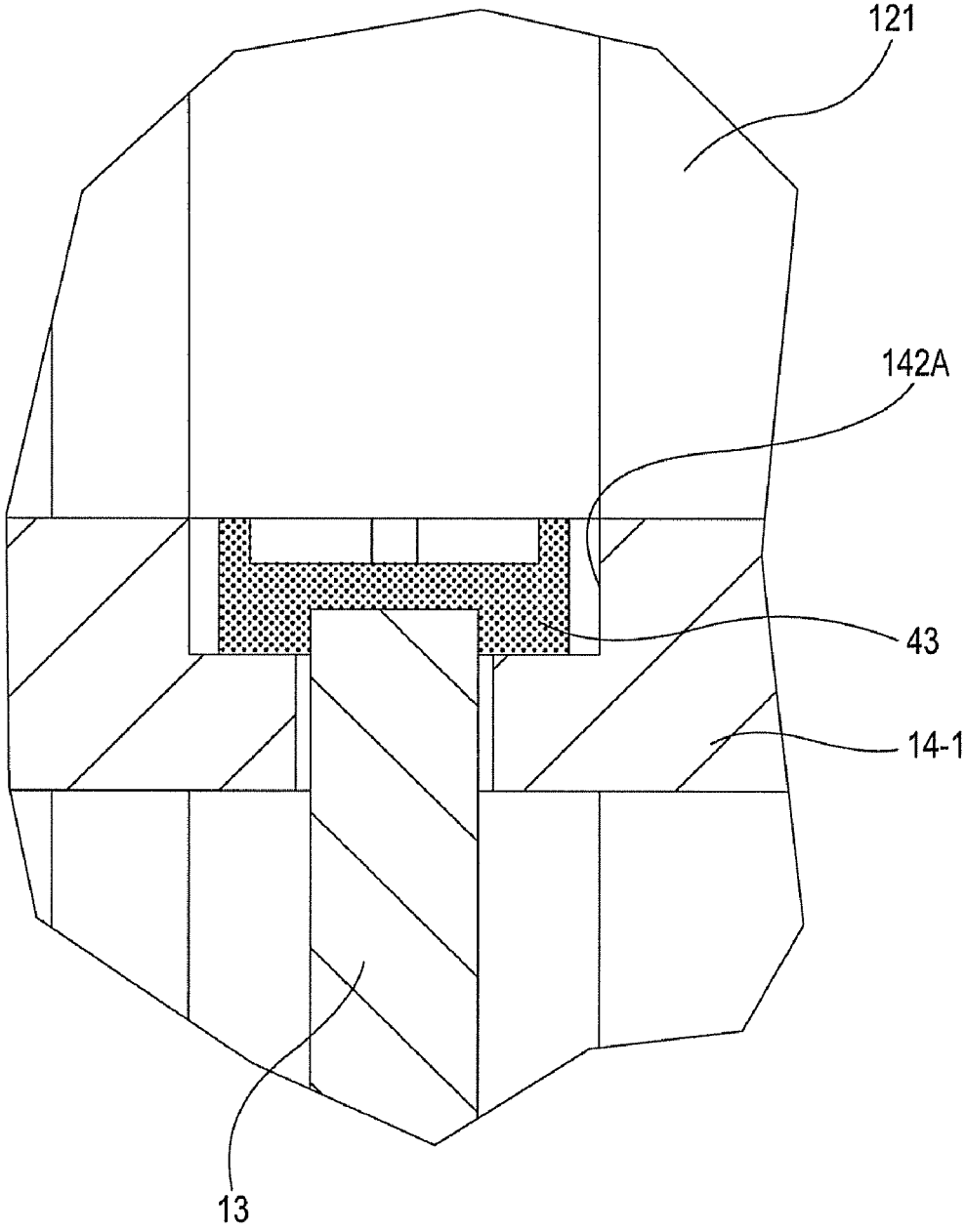
FIG. 13 is an enlarged partial view of the stopper and its surroundings in FIG. 12.

FIG. 12 illustrates the stopper 43 and its surroundings in FIG. 11. FIG. 13 is an enlarged view illustrating a part of a stopper section in FIG. 12. As illustrated in FIGS. 12 and 13, the holes 142A each have a large-diameter upper portion and a small-diameter lower portion, and the stopper 43 is fitted in the large-diameter portion of the hole 142A. In this embodiment, the diameter of the small-diameter portion of the hole 142A is equal to the diameter of the other holes 142. The stoppers 43 are fixed to the leading ends of the pins 13 at the four corners by a known fixing method such as screwing, bonding, or soldering.

Guide portions 125 provided on side walls 121 are engaged with cutouts 145 of the cover 14-1, guides movement of the cover 14-1 between the first and second positions. Further, the pins 13 themselves guides movement of the cover 14-1 between the first and second positions. For this reason, the cover 14-1 can smoothly and stably move between the first and second positions. Also, upward movement of the cover 14-1 beyond the first position, that is, movement in a direction opposite the second position is restricted by the stoppers 43 fixed to the leading ends of the specific pins 13.

The pins 13 having the leading ends to which the stoppers 43 are fixed are not limited to the pins 13 provided at the four corners, and the positions of the pins 13 with the stoppers 43 are not particularly limited as long as the cover 14-1 can be smoothly and stably moved between the first and second positions by the above-described guide portion. However, to ensure a small and stable movement of the cover 14-1, an embodiment fixes the stoppers 43 to at least three pins 13.

Since the layout of magnets 141 and electromagnets 16 in the connector 21 can be equal to that adopted in the connector 11, illustration and description thereof are omitted.

Figure 14:
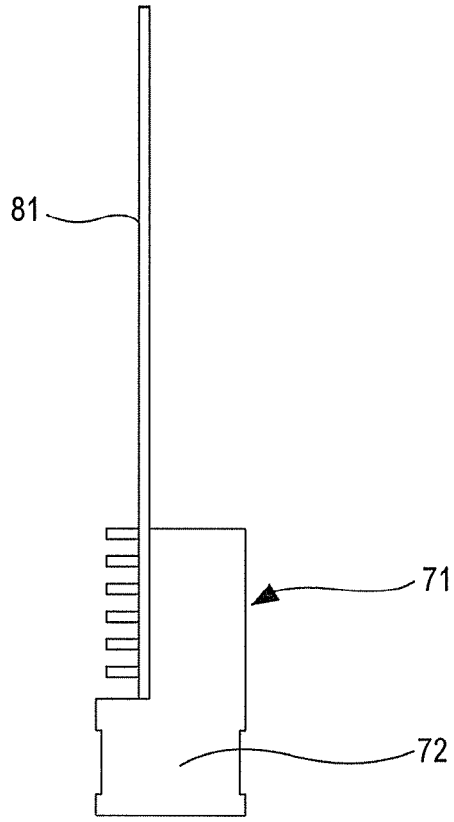
FIG. 14 illustrates a male connector and a female connector.
Figure 14:
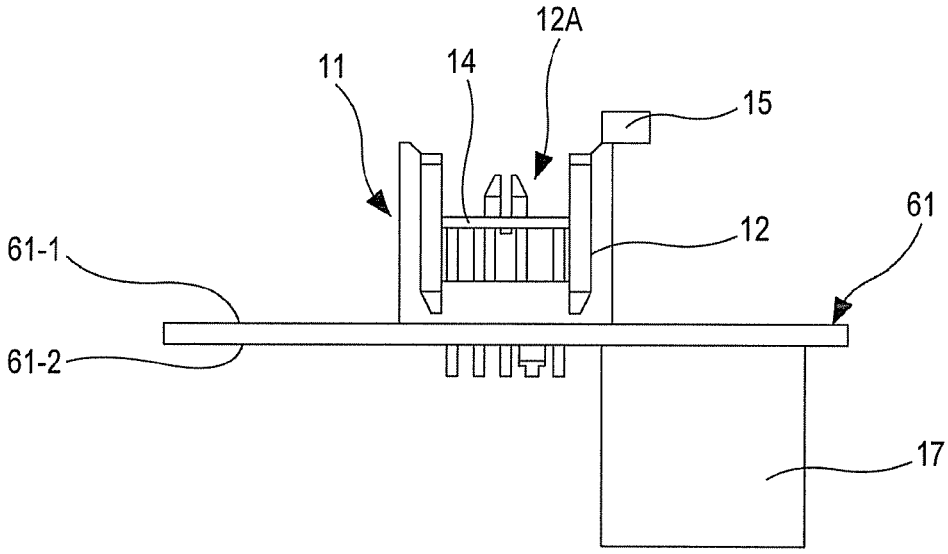

Next, a description will be given of connection of connectors. FIG. 14 illustrates a male connector and a female connector. In FIG. 14, the same components as those in FIG. 2 are denoted by the same reference numerals, and descriptions thereof are omitted. While the male connector has a structure similar to that of the connector 11 in FIG. 2 for convenience of explanation, it may have a structure similar to that of the connector 21 in FIG. 10. Further, a control unit 17 is externally attached to the connector 11 in this example.

A male connector 11 is mounted on an upper surface 61-1 of a substrate 61 such as a so-called printed circuit board, and the control unit 17 is mounted on a lower surface 61-2 of the substrate 61. The control unit 17 is electrically connected to a detection unit 15 and an electromagnet 16 of the connector 11 by wires (not shown) provided on the lower surface 61-2 and the upper surface 61-1 of the substrate 61, as illustrated in FIG. 5. The control unit 17 may have a function of controlling other components and circuits mounted on the substrate 61. A plurality of pins 13 of the connector 11 are electrically connected to the other components and circuits mounted on the substrate 61 by wires or wiring patterns provided on at least one of the upper surface 61-1 and the lower surface 61-2 of the substrate 61.

A female connector 71 has a frame portion 72, and is attached to a substrate 81 such as a so-called printed circuit board. In the frame portion 72, a plurality of terminals (not shown) that can be electrically connected to the pins 13 of the male connector 11 are provided. For example, when components and circuits are mounted on the substrate 81, the terminals in the frame portion 72 are electrically connected thereto by wires or wiring patterns provided on at least one of an upper surface and a lower surface of the substrate 81.

In a state illustrated in FIG. 14, the female connector 71 is not inserted in an inner space 12A of a frame section 12 of the male connector 11, and therefore, the detection unit 15 of the male connector 11 does not output a detection signal. Since the control unit 17 brings electromagnets 16 into a normal ON state for generating a magnetic field having the same polarity as that of magnets 141 during a period when a detection signal is not output from the detection unit 15, a cover 14 is at the first position. For this reason, the pins 13 in the frame section 12 of the male connector 11 are reliably protected by the cover 14 at the first position.

Figure 15:
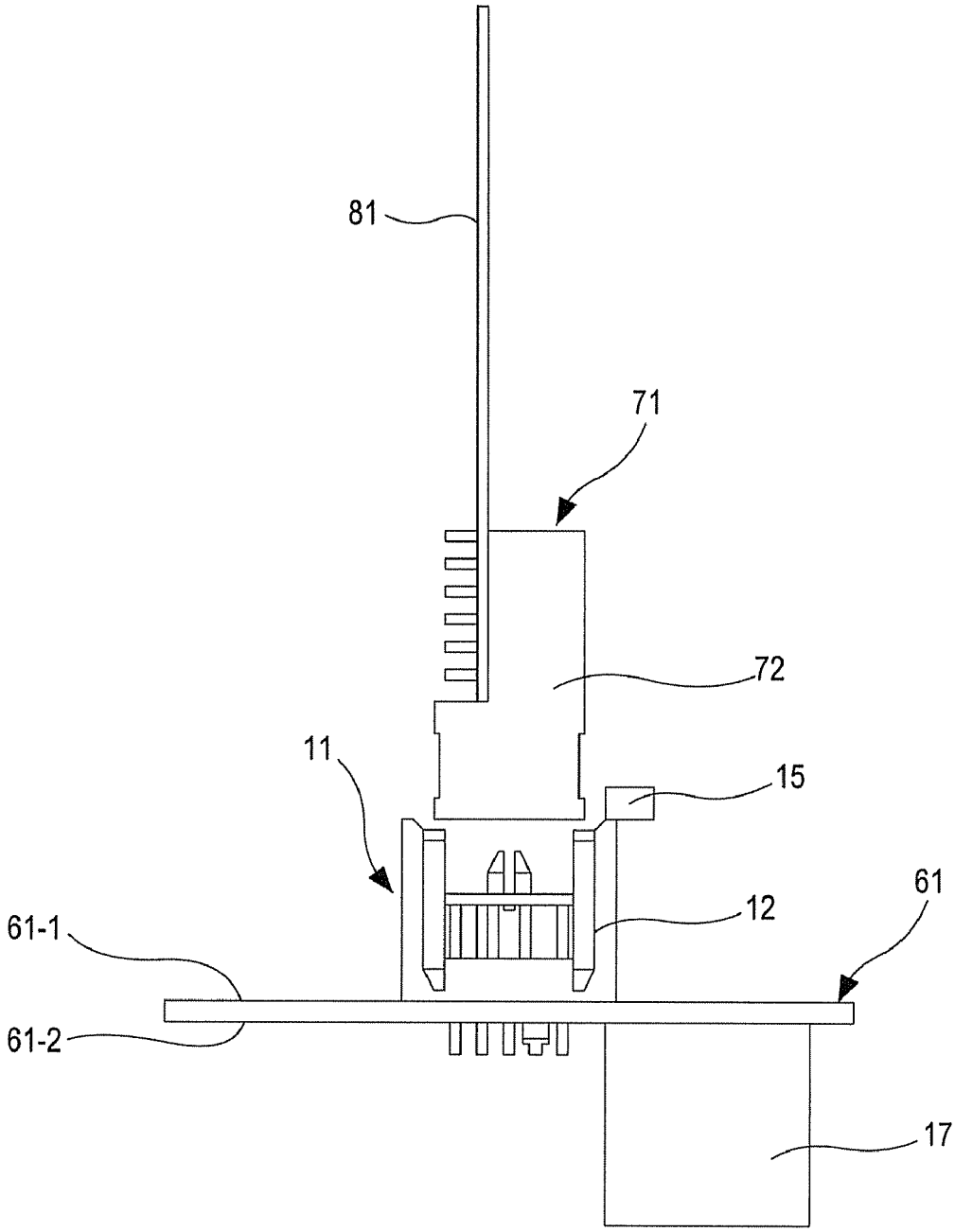
FIG. 15 is a side view illustrating connection of the connectors shown FIG. 14.

FIG. 15 illustrates a state in which the connectors 11 and 71 illustrated in FIG. 14 are to be connected. Referring to FIG. 15, when the frame portion 72 of the female connector 71 is inserted in the inner space 12A of the frame section 12 of the male connector 11 and reaches the detection unit 15 provided in the frame section 12, the detection unit 15 outputs a detection signal. In response to the detection signal, the control unit 17 brings the electromagnets 16 in an OFF state, or a reverse ON state for generating a magnetic field having a polarity opposite the polarity of an opposing surface of the magnet 141, and therefore, the cover 14 moves from the first position in FIG. 15 to the second position. With this structure, when the frame portion 72 of the female connector 71 is inserted in the inner space 12A of the frame section 12 of the male connector 11, the cover 14, which has protected the pins 13, moves to the second position and does not interfere with the insertion operation. Hence, the frame portion 72 is guided by inner walls including guide portions 125 provided in side walls 121 of the frame section 12, so that the female connector 71 can be smoothly and stably connected to the male connector 11.

Figure 16:
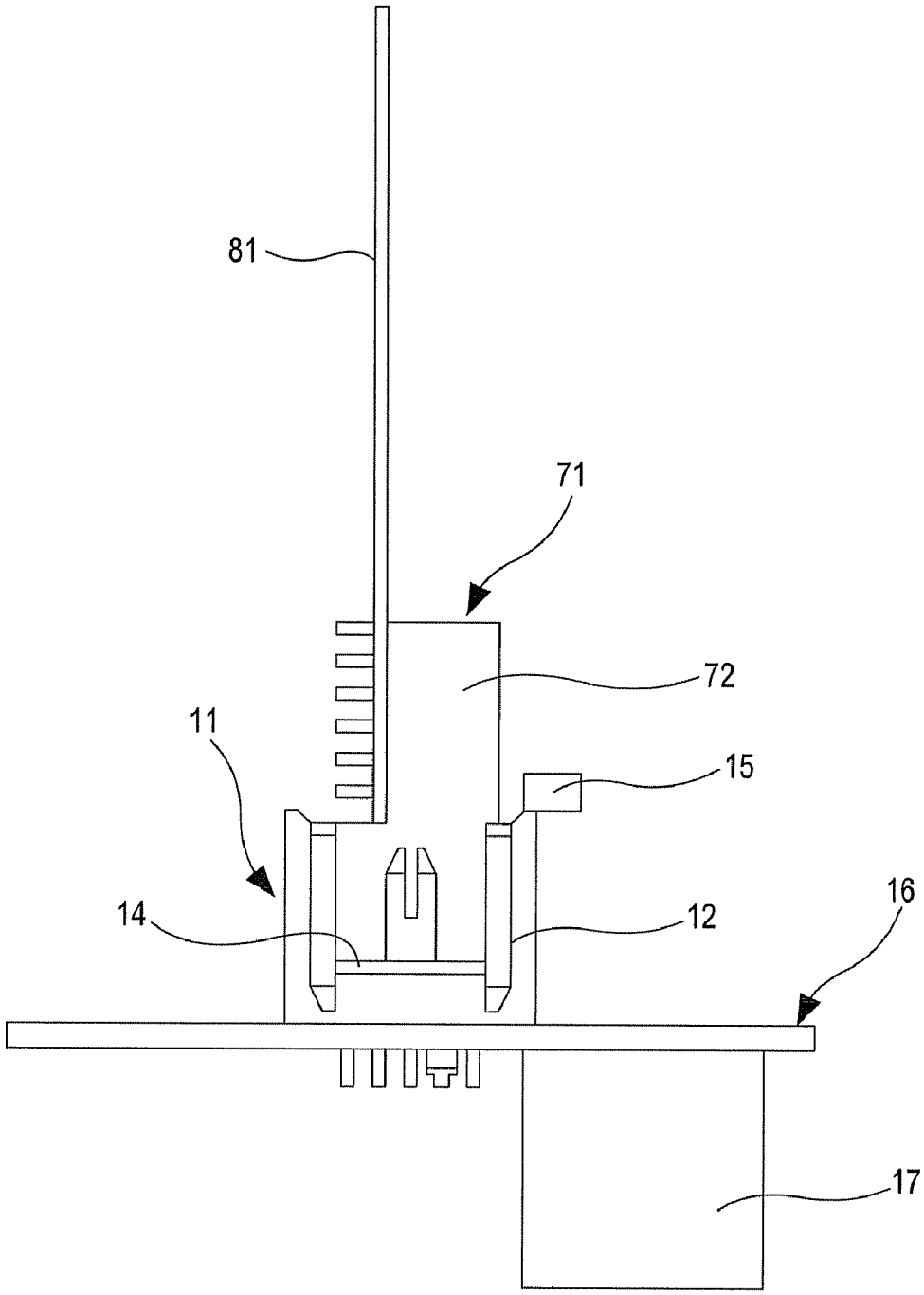
FIG. 16 is a side view illustrating connection of the connectors in FIG. 14.
Figure 17:
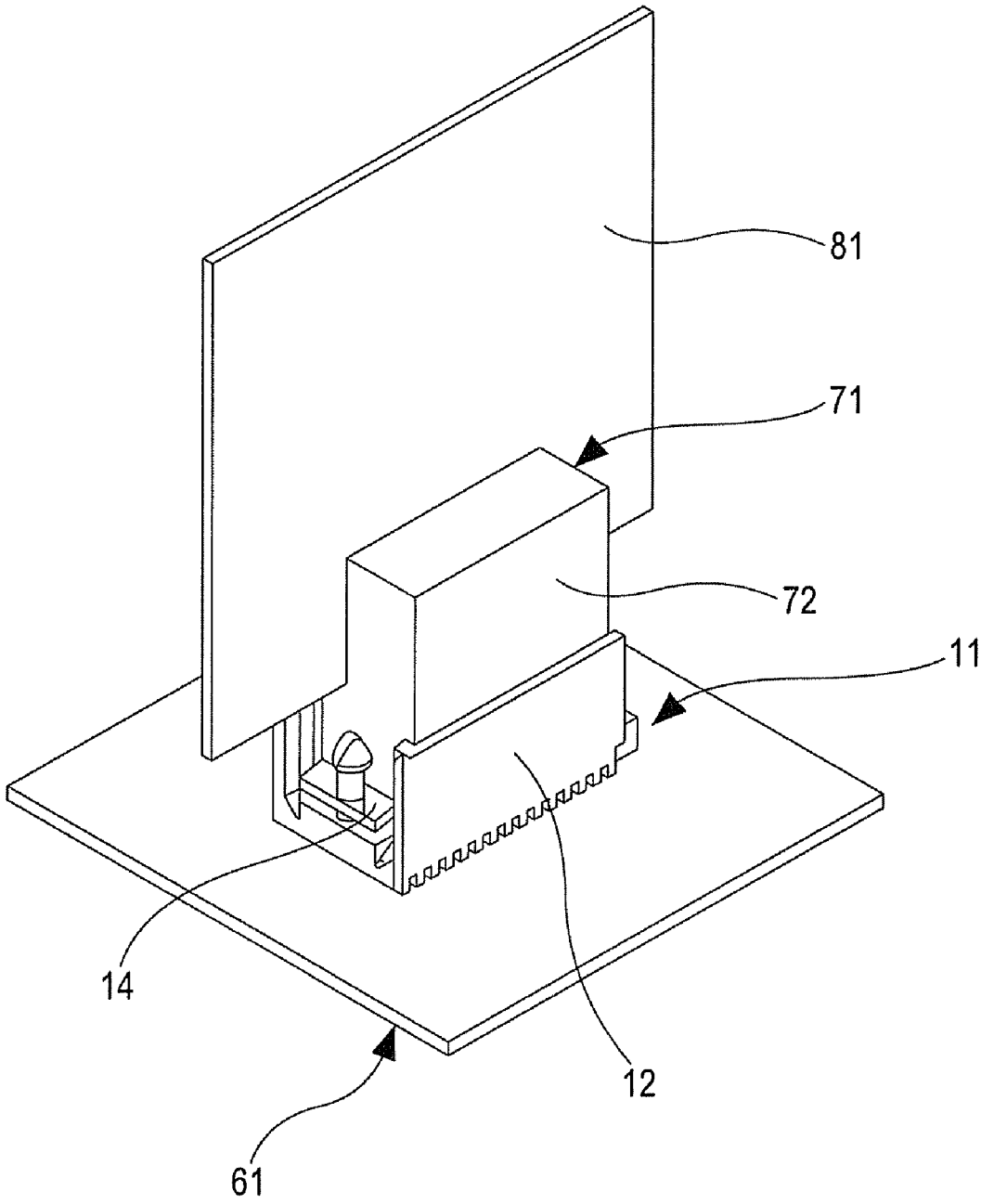
FIG. 17 is a perspective view illustrating connection of the connectors in FIG. 14.
Figure 18:
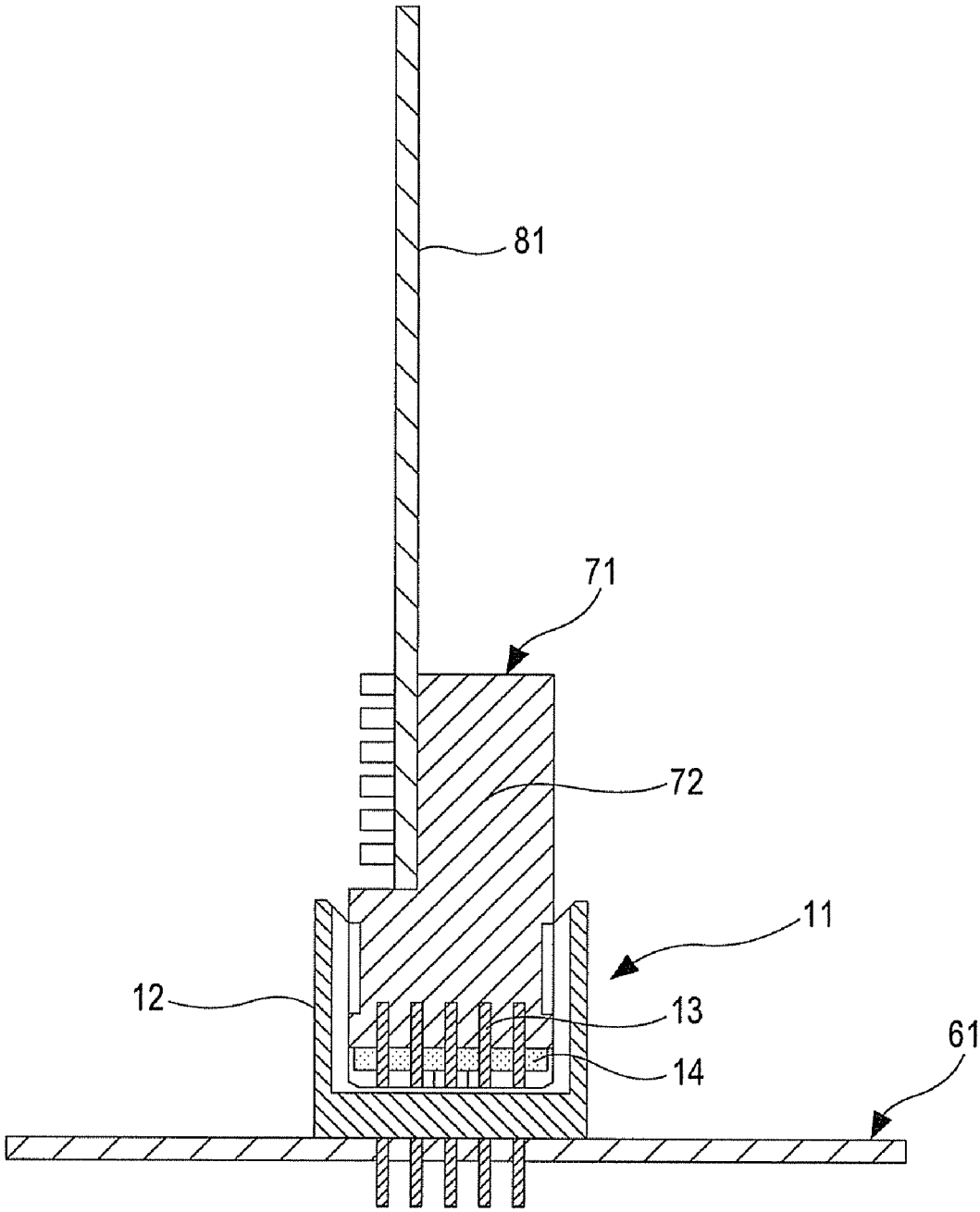
FIG. 18 is a cross-sectional view illustrating connection of the connectors in FIG. 14.

FIGS. 16, 17, and 18 are a side view, a perspective view, and a cross-sectional view, respectively, illustrating a state in which the connectors 11 and 17 in FIG. 14 are connected to each other. In the state illustrated in FIGS. 16 to 18, a plurality of terminals in the frame portion 72 of the female connector 71 are electrically connected to the corresponding pins 13 in the frame section 12 of the male connector 11.

As illustrated in FIGS. 14 to 18, it is unnecessary to form, on the substrate 61, special guide pins for guiding connection of the connectors 11 and 17. Also, it is unnecessary to form guide holes in the substrate 81 corresponding to the guide pins. For this reason, the available areas of the substrates 61 and 81 and flexibility in laying out the wires and elements will not be reduced by the mechanism that allows smooth and stable connection of the connectors 11 and 71. Further, since the connectors 11 and 71 can be easily connected even when the substrates 61 and 81 are orthogonal to each other, as illustrated in FIG. 17, they can be smoothly and stably connected even when the substrates 61 and 81 are not parallel to each other. This improves the flexibility in laying out substrates and devices connected by the connectors.

In an embodiment, a method of manufacturing a connector as described herein is provided. The connector is controlled such that a cover thereof selectively adjusts between a first position and a second position including based on a signal indicating an insertion of an external member into an inner space defined by a pair of side walls.

Further, operations including a process of manufacturing a connector having elements discussed herein may be implemented in computing hardware (computing apparatus) and/or software, such as (in a non-limiting example) any computer that can store, retrieve, process and/or output data and/or communicate with other computers. The results produced in associate with the connector can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW. An example of communication media includes a carrier-wave signal.

Further, according to an aspect of the embodiments, any combinations of the described features, functions and/or operations can be provided.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A connector, comprising:

a frame section including an inner space defined by a pair of opposing side walls and a bottom portion connecting the side walls;

a plurality of pins protruding in a columnar manner from the bottom portion within the inner space;

a cover including a magnet, a plurality of holes through which the pins pass being formed on the cover, and the cover being movable along the pins in the inner space between a first position to protect the pins and a second position to expose the pins;

a detection unit provided in the frame section and configured to output a detection signal when detecting insertion of an external member in the inner space; and an electromagnet provided at a position on the bottom portion opposing the magnet.

2. The connector according to claim 1, comprising:

a control unit configured to move the cover to the first position by bringing the electromagnet in a normal ON state for generating a magnetic field having polarity equal as a polarity of a surface of the magnet opposing to the electromagnet during a period when the detection signal is not input, and wherein the control unit is configured to move the cover to the second position by bringing the electromagnet in an OFF state, or a reverse ON state for generating a magnetic field having a polarity opposite the polarity of the surface of the magnet opposing to the electromagnet, when the detection signal is input.

3. The connector according to claim 2, wherein the cover is formed by a plate-shaped member.

4. The connector according to claim 2, wherein the detection unit is any of an optical sensor, a contact sensor, and an ultrasonic sensor.

5. The connector according to claim 2, wherein a protrusion amount of the pins is such that leading ends of the pins do not protrude from upper edges of the opposing side walls, and do not protrude from the holes of the covers when the cover is at the first position.

6. The connector according to claim 5, wherein the magnet is provided on an opposing surface of the cover opposing the bottom portion.

7. The connector according to claim 6, wherein the magnet is provided at a position on the opposing surface of the cover except over an area of the holes.

8. The connector according to claim 7, wherein the cover includes first opposing sides movable along the opposing side walls and second opposing sides connected to ends of the first opposing sides, and wherein the magnet is provided along the second opposing sides.

9. The connector according to claim 8, wherein at least two of the pins have at leading ends thereof stoppers configured to restrict a movement of the cover beyond the first position in a direction opposite the second position.

10. The connector according to claim 7, comprising:

a pair of guide pins protruding in a columnar manner from the bottom portion in a direction as a protruding direction of the pins, and wherein the cover includes first opposing sides movable along the opposing side walls, second opposing sides connecting ends of the first opposing sides, and guide holes through which the guide pins pass, the guide holes being provided near the second opposing sides.

11. The connector according to claim 10, wherein the guide pins have at leading ends thereof stoppers configured to restrict the movement of the cover beyond the first position in the direction opposite the second position.

12. The connector according to claim 11, wherein the opposing side walls have guide means for guiding movement of the cover between the first and second positions.

13. A device, comprising:

a substrate;

a connector provided on the substrate; and a control unit provided on the substrate, wherein the connector includes:

a frame section including an inner space defined by a pair of opposing side walls and a bottom portion connecting the side walls;

a plurality of pins protruding in a columnar manner from the bottom portion in the inner space;

a cover including a magnet and a plurality of holes through which the pins pass are formed on the cover, the cover being movable along the pins in the inner space between a first position to protect the pins and a second position to expose the pins; and a detection unit provided in the frame section and configured to output a detection signal when detecting insertion of an external member in the inner space, and wherein the control unit moves the cover to the first position by bringing an electromagnet opposing the magnet in a normal ON state for generating a magnetic field having a polarity as a polarity of a surface of the magnet opposing to the electromagnet during a period when the detection signal is not input, and moves the cover to the second position by bringing the cover in an OFF state, or a reverse ON state for generating a magnetic field having a polarity opposite the polarity of the surface of the magnet opposing to the electromagnet, when the detection signal is input.

14. The device according to claim 13, wherein the electromagnet is provided on the substrate.

* * * * *